US007955099B2

(12) United States Patent
Tan

(10) Patent No.: US 7,955,099 B2
(45) Date of Patent: Jun. 7, 2011

(54) CARD EDGE CONNECTOR

(75) Inventor: Chin Guan Tan, Singapore (SG)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/644,507

(22) Filed: Dec. 22, 2009

(65) Prior Publication Data

US 2010/0159723 A1 Jun. 24, 2010

(30) Foreign Application Priority Data

Dec. 23, 2008 (SG) ..... 200809517-6

(51) Int. Cl.
*H01R 13/44* (2006.01)

(52) U.S. Cl. ..... 439/157; 439/159

(58) Field of Classification Search ..... 439/157–159
See application file for complete search history.

(56) References Cited

U.S. PATENT DOCUMENTS

| | | | | | |
|---|---|---|---|---|---|
| 5,139,435 | A * | 8/1992 | Komatsu et al. | ..... | 439/159 |
| 5,577,922 | A * | 11/1996 | Enomoto et al. | ..... | 439/157 |
| 5,730,611 | A * | 3/1998 | Cheng et al. | ..... | 439/160 |
| 6,036,513 | A * | 3/2000 | Nishioka | ..... | 439/159 |
| 6,089,889 | A * | 7/2000 | Chiou et al. | ..... | 439/159 |
| 6,210,188 | B1 * | 4/2001 | Chang | ..... | 439/159 |
| 6,413,106 | B1 * | 7/2002 | Yu | ..... | 439/159 |
| 6,814,597 | B1 * | 11/2004 | Kao | ..... | 439/159 |
| 7,090,537 | B1 * | 8/2006 | Nakamura | ..... | 439/630 |
| 7,866,995 | B1 * | 1/2011 | Kudo | ..... | 439/157 |

* cited by examiner

*Primary Examiner* — Truc T Nguyen
(74) *Attorney, Agent, or Firm* — Stephen L. Sheldon

(57) ABSTRACT

A card edge connector comprises an insulating housing provided with a plurality of terminals, an actuator, an engaging member and a force transmitter. The insulating housing comprises at least one end tower disposed at an end thereof The actuator includes a push arm substantially linearly movable within the end tower. The engaging member, pivoted to rotate within the end tower, is configured to secure an inserted card and to eject the inserted card. The force transmitter, pivoted to rotate within the end tower, is able to engage with the push arm of the actuator and the engaging member. The force transmitter is actuated by the actuator to apply a force to rotate the engaging member and change a direction of the force in response to rotation of the engaging member.

10 Claims, 21 Drawing Sheets

CARD EDGE CONNECTOR

RELATED APPLICATIONS

This application claims priority to Singapore Application No. 200809517.6, filed Dec. 23, 2008, which is incorporated herein by reference in its entirety.

FIELD OF THE INVENTION

The present invention relates to a card edge connector, and more particularly, to a card edge connector having mechanisms for ejecting and latching cards.

DESCRIPTION OF THE RELATED ART

Card edge connectors, due to their flexibility and ease of use, are widely adopted in electronic devices for expanding their capabilities. For example, a computer system equipped with several card edge connectors for memory modules can have increased memory capacity by installing additional memory modules to the card edge connectors, or by replacing the memory module having less storage capacity with the memory module having larger storage capacity. The card edge connectors are configured to temporarily receive cards, and some of them are furnished with ejection mechanisms for smoothly removing inserted cards. Generally, the ejection mechanism comprises a handle means and a rotating means engageable with the handle means and an edge of an inserted card. During a card ejection process, the handle means rotates the rotating means by a force applied thereon, and the edge of the inserted card is pushed by the rotating means to eject the card.

With the ongoing improvement in the capabilities of electronic cards, the numbers and the sizes of electronic components, such as Integrated Circuit (IC) chips, which are mounted on the cards, are increasing. Such increases in the components mounted on the cards also increase the size of the cards. When the cards of larger sizes are closely arranged, the handle means becomes difficult for the user to access to apply ejection force thereon. Damage to the card or to the card edge connector may occur due to improper ejection operation of the card.

In addition, cards supplied by manufacturers may have various mechanical outlines, and each of the card edge connectors is usually designed to adopt only one type of mechanical outline. When a user chooses a new card with a mechanical outline different from the outline of the card used before, the new card may not be secured properly.

Moreover, the effective lever arm length in most prior art ejection mechanisms changes during the card ejection process. This change lowers the leverage efficiency, requiring the user to apply a larger force to eject a card, and there is a damage risk to the card edge connector when a larger force is applied to it.

In light of the above-mentioned problems, conventional card edge connectors have significant limitations and cannot satisfy all application requirements, and therefore a new card edge connector, which can be easily and safely operated and adapted for cards with different mechanical outlines is required.

SUMMARY OF THE INVENTION

An objective of the present invention is to provide a new and improved card edge connector that can easily and safely eject an inserted card.

In order to achieve the above objective, a card edge connector for receiving a card having a plurality of notches in opposite side edges respectively and an elongated edge along which a plurality of contact pads are provided is disclosed according to one embodiment of the present invention. The card edge connector comprises an insulating housing, a plurality of terminals, an actuator, an engaging member and a force transmitter. The insulating housing comprises at least one end tower and each end tower is disposed at an end of the insulating housing. The terminals are provided within the insulating housing, and when the insulating housing receives the elongated edge of the card, the terminals electrically and mechanically engage the contact pads of the card. The actuator includes a push arm that is substantially linearly movable within the end tower. The engaging member that is pivoted to rotate within the end tower is configured to rotate in one direction to secure the card and rotate in another direction to eject the card. The force transmitter, which is pivoted to rotate within the end tower, is able to engage with the push arm of the actuator and the engaging member. The force transmitter is actuated by the actuator to apply a force to rotate the engaging member and changes a direction of the force in response to rotation of the engaging member.

BRIEF DESCRIPTION OF THE DRAWINGS

The features in the appended drawings are illustrated by way of example and not limited in the accompanying figures in which like reference numerals indicate similar elements and in which.

DETAILED DESCRIPTION OF THE INVENTION

Hereinafter, embodiments of the card edge connector having an ejection mechanism will be described in detail with reference to the attached drawings. It should be noted that the various features disclosed below are not intended to be limited to the expressly disclosed combination(s). Therefore, unless otherwise noted, features disclosed herein may be combined together to form additional combinations that were not otherwise shown for purposes of brevity.

Figure 1:
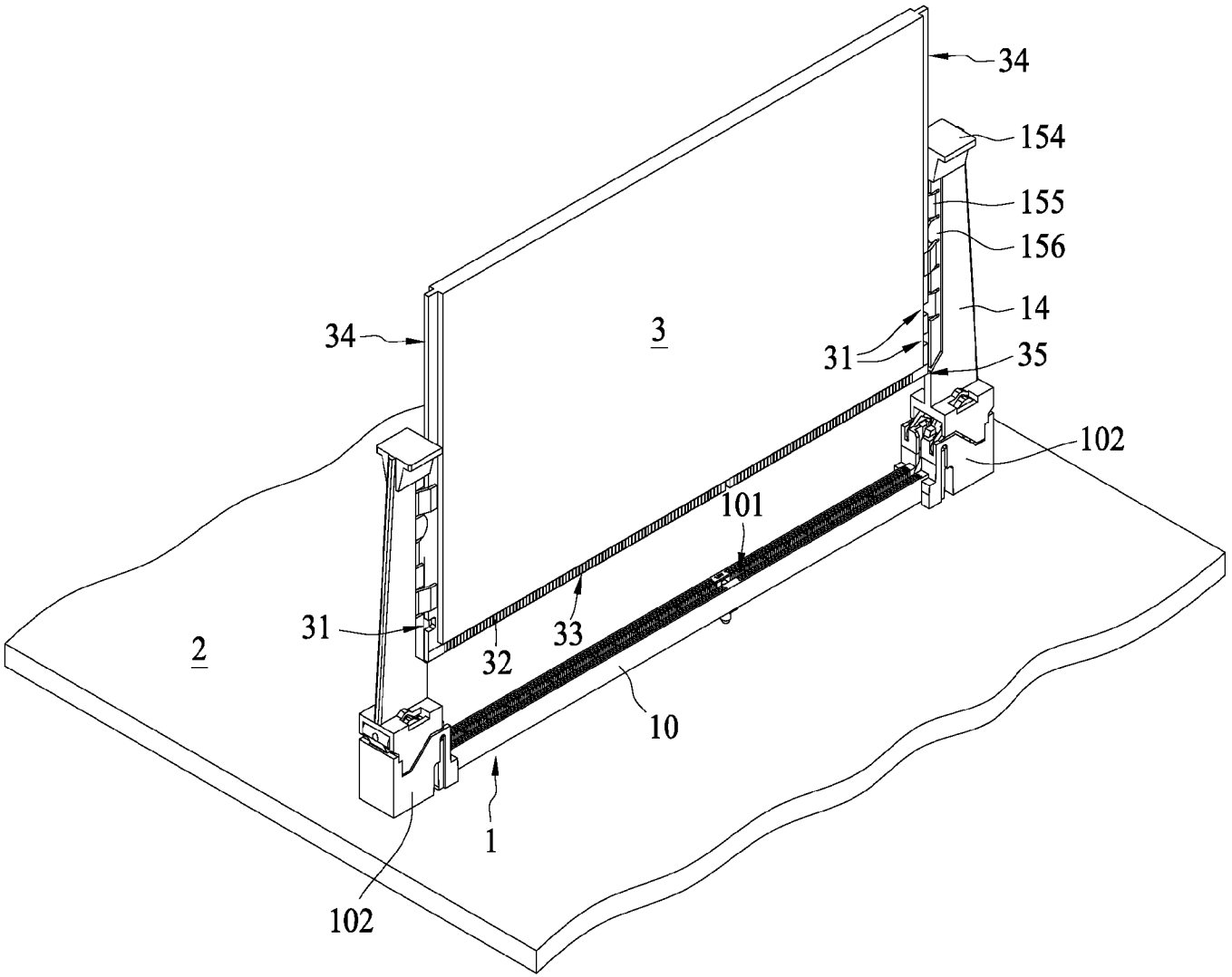
FIG. 1 illustrates a card edge connector and a card that is placed above the card edge connector according to one embodiment of the present invention.
Figure 2:
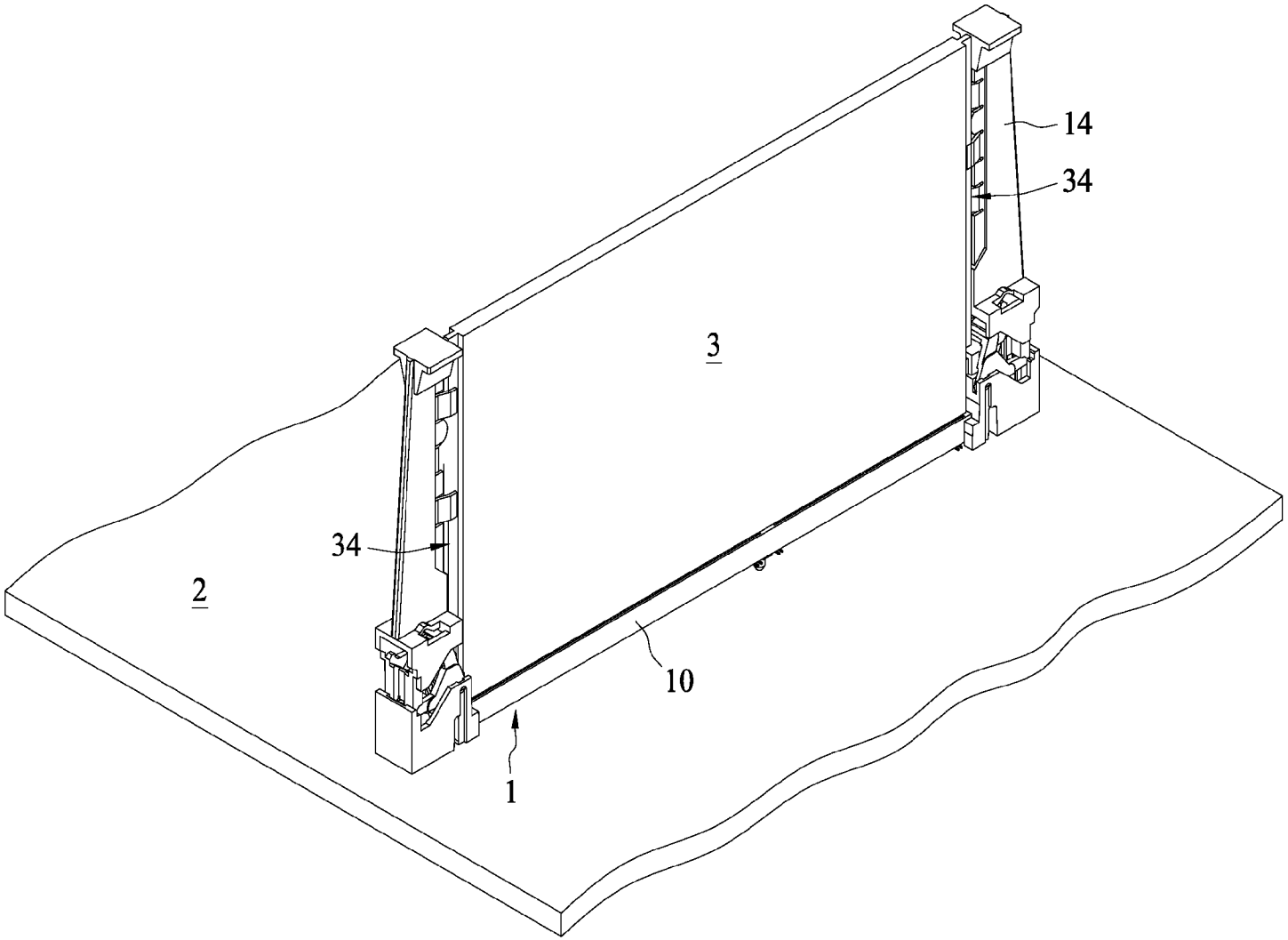
FIG. 2 illustrates a card edge connector that is receiving a card according to one embodiment of the present invention.

As illustrated in FIGS. 1 and 2, the card edge connector 1, mounted on a printed circuit board 2, is configured to receive a card 3 vertically oriented. The card 3 comprises a plurality of notches 31, a plurality of contact pads 32 and an elongated edge 33. The notches 31 are arranged in pairs and disposed on two sides of the edges 34, respectively. The contact pads 32 are provided along the elongated edge 33.

Figure 3:
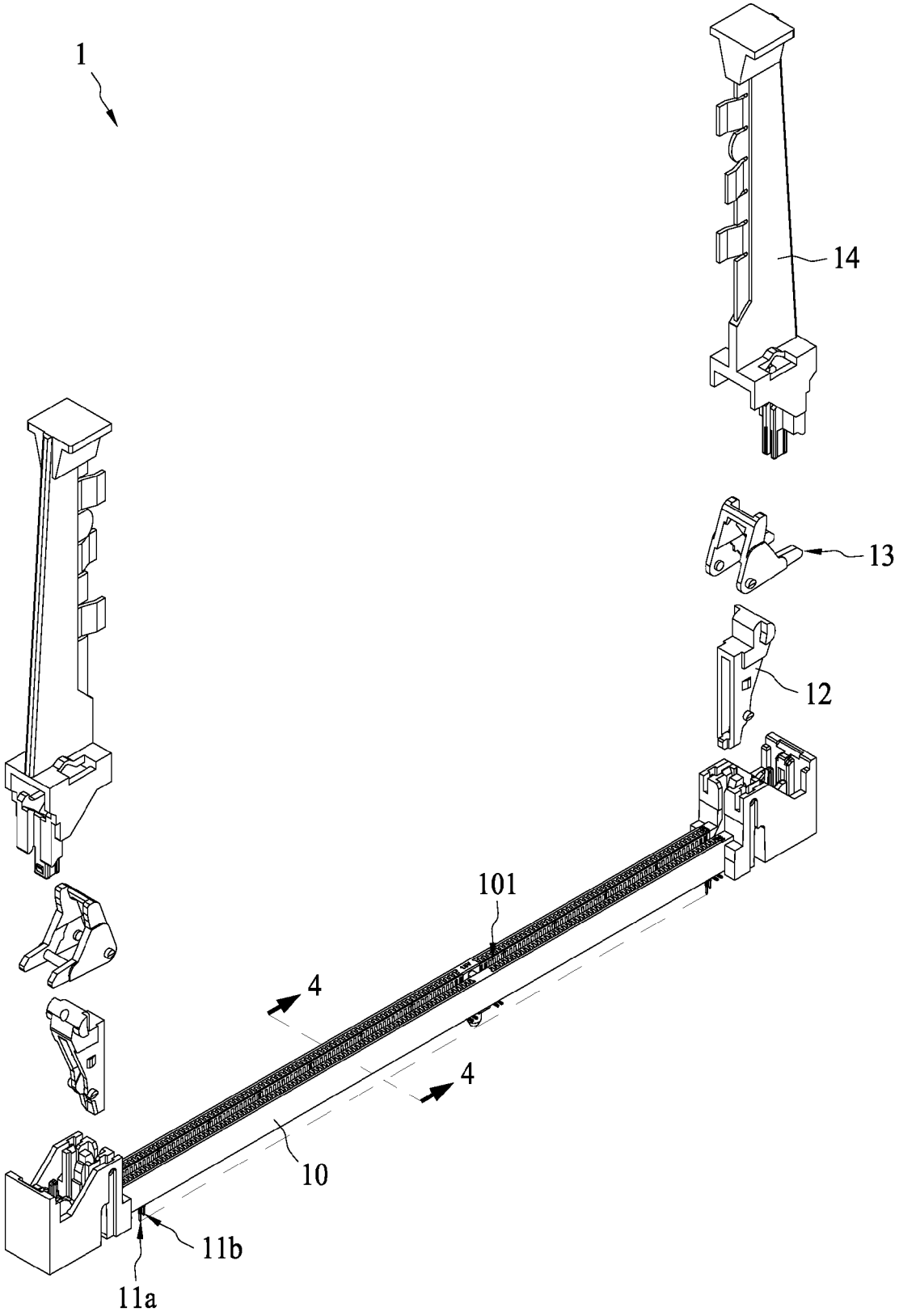
FIG. 3 illustrates a card edge connector according to one embodiment of the present invention.
Figure 4:
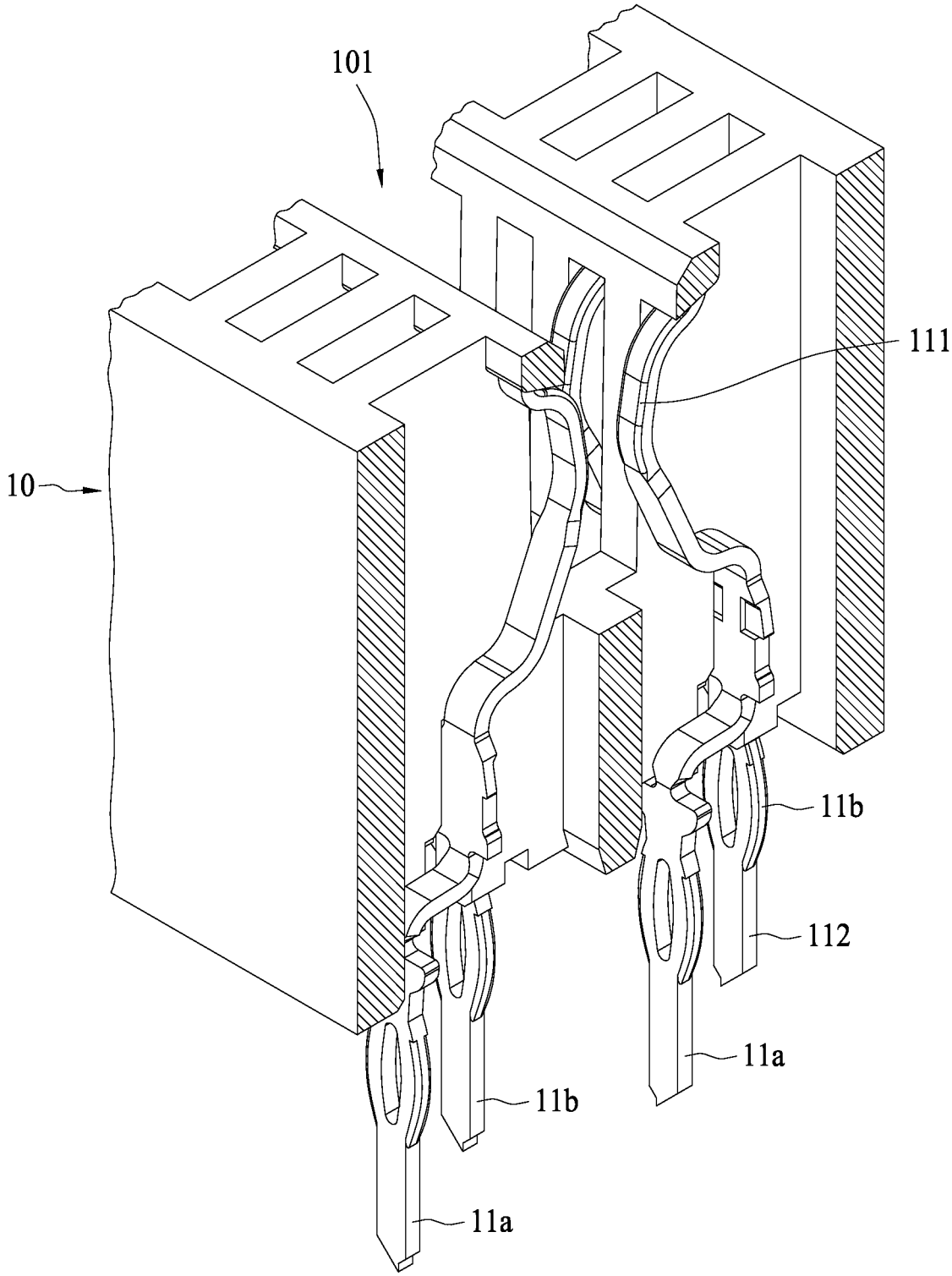
FIG. 4 is a perspective view of an insulating housing in partial cross section along line 4-4.

Referring primarily to FIG. 3, but also to FIG. 1 and FIG. 4, the card edge connector 1 comprises an insulating housing 10, a plurality of terminals 11*a* and 11*b*, a pair of engaging members 12, a pair of force transmitters 13 and a pair of actuators 14. The insulating housing 10 comprises a receptacle 101 for receiving the card 3 and a pair of end towers 102. The terminals 11*a* and 11*b* are provided within the insulating housing 10 and arrayed in pairs along the insulating housing 10 as shown in FIG. 4. Each of the terminals 11*a* and 11*b* comprises a contact portion 111 that bows into the receptacle 101 and a pin portion 112 that extends straight downward. The contact portions 111 are electrically coupled to the respective contact pads 32 of the card 3 when the card 3 is received within the receptacle 101. The card edge connector 1 is secured to the printed circuit board 2 by the pin portions 112 being press fitted or soldered to the respective apertures (not shown) of the printed circuit board 2.

Referring primarily to FIG. 3, but also to FIG. 2, the card edge connector 1 of the present embodiment is equipped with two card ejection mechanisms at the ends of the insulating housing 10. At each end of the insulating housing 10, an end tower 102 is disposed. Each end tower 102 receives therewithin a respective engaging member 12 and a respective force transmitter 13, all of which are pivoted to rotate within the end tower 102. Each end tower 102 also provides support to the respective actuator 14 and thus the actuators 14 are erected beside the vertically standing card 3. As shown in FIG. 2, the actuators 14 can be designed as high as the height of a large card 3 so that a user can easily operate the ejection mechanism without any problem.

Figure 5:
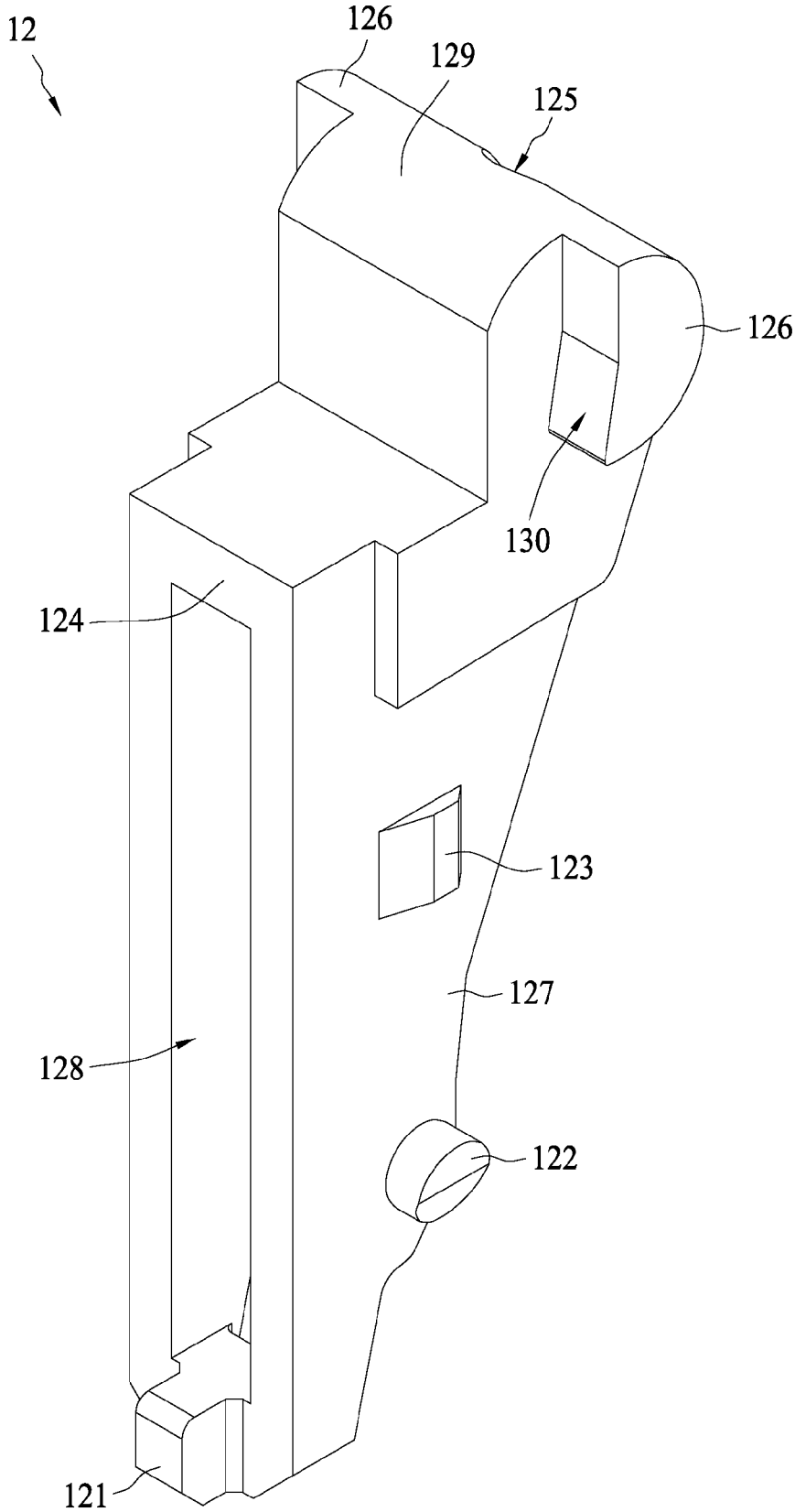
FIG. 5 is a perspective view of an engaging member according to one embodiment of the present invention.
Figure 10A:
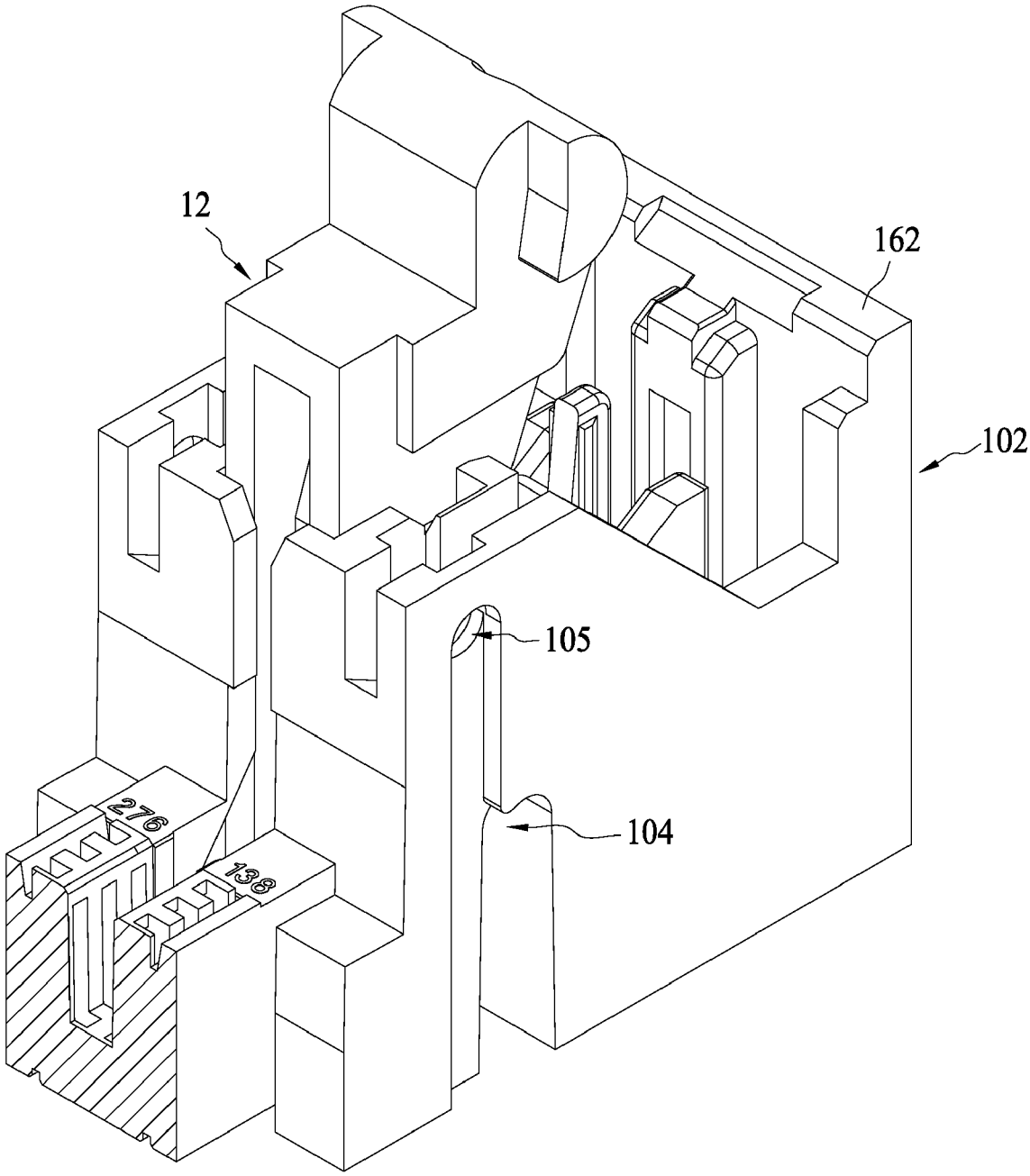
FIG. 10A is a perspective view showing an embodiment of an engaging member installed in an end tower.

Referring primarily to FIG. 5, but also to FIG. 1 and FIG. 10A, the engaging member 12 comprises an ejection portion 121, a pair of member pivots 122, a pair of bumps 123, a latch portion 124 and a head portion 125. The head portion 125 comprises a pair of shoulders 126. Each shoulder 126 has an engaging surface 130 facing in a direction substantially orthogonal to the longitudinal direction of the engaging member 12. The ejection portion 121 is able to engage the edge part, close to a respective card corner 35 (as shown in FIG. 1), of the elongated edge 33 of the card 3 to eject the card from the card edge connector 1. The elongated edge 33 of the card 3 can also be used to push the ejection portion 121 to rotate the engaging member 12 to a lock position as shown in FIG. 10A. When the engaging member 12 is in the lock position, the card 3 is secured by the latch portion 124.

The member pivots 122 and the bumps 123 are provided on the side surfaces 127 of the engaging member 12 respectively so that the engaging member 12 can rotate on the member pivots 122, but the movement of the engaging member 12 is limited by the bumps 123. The latch portion 124, which is configured to secure the card 3, is provided to be able to engage the respective notch 31. The latch portion 124 latches into the respective notch 31 when the engaging member 12 is rotated to the lock position (as shown in FIG. 10A). A slot 128 is provided between the latch portion 124 and the ejection portion 121. The slot 128 allows the card 3 to slide without interference during card insertion and card ejection operations. The head portion 125 includes a curved top surface 129. The shoulders 126 are at the two opposite sides of the head portion 125. The functionalities of the head portion 125 and the shoulders 126 will be described in more detail later.

Figure 6:
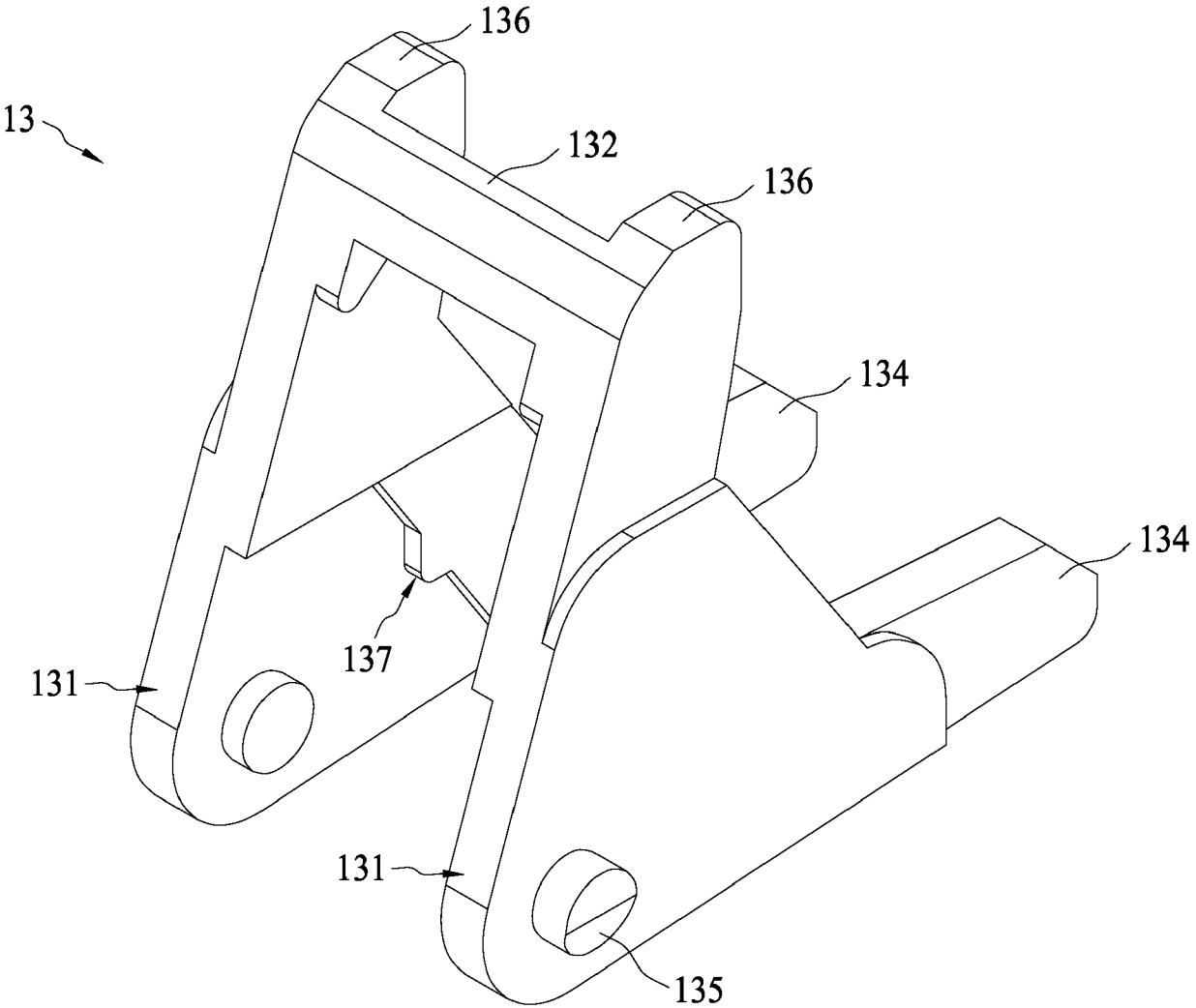
FIG. 6 shows a force transmitter according to one embodiment of the present invention.
Figure 9A:
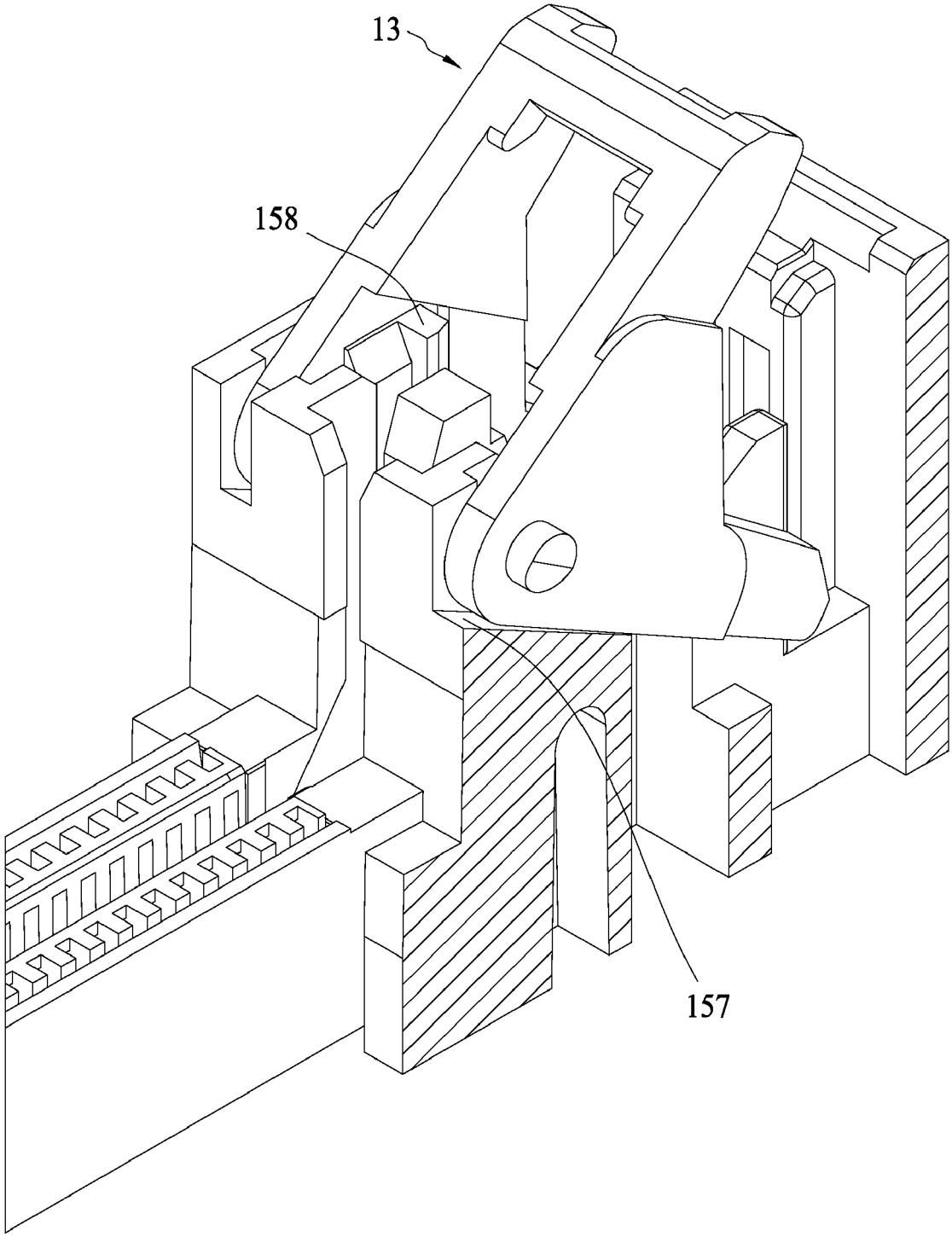
FIG. 9A is perspective cross-sectional view of an embodiment of a force transmitter in a first position.
Figure 9B:
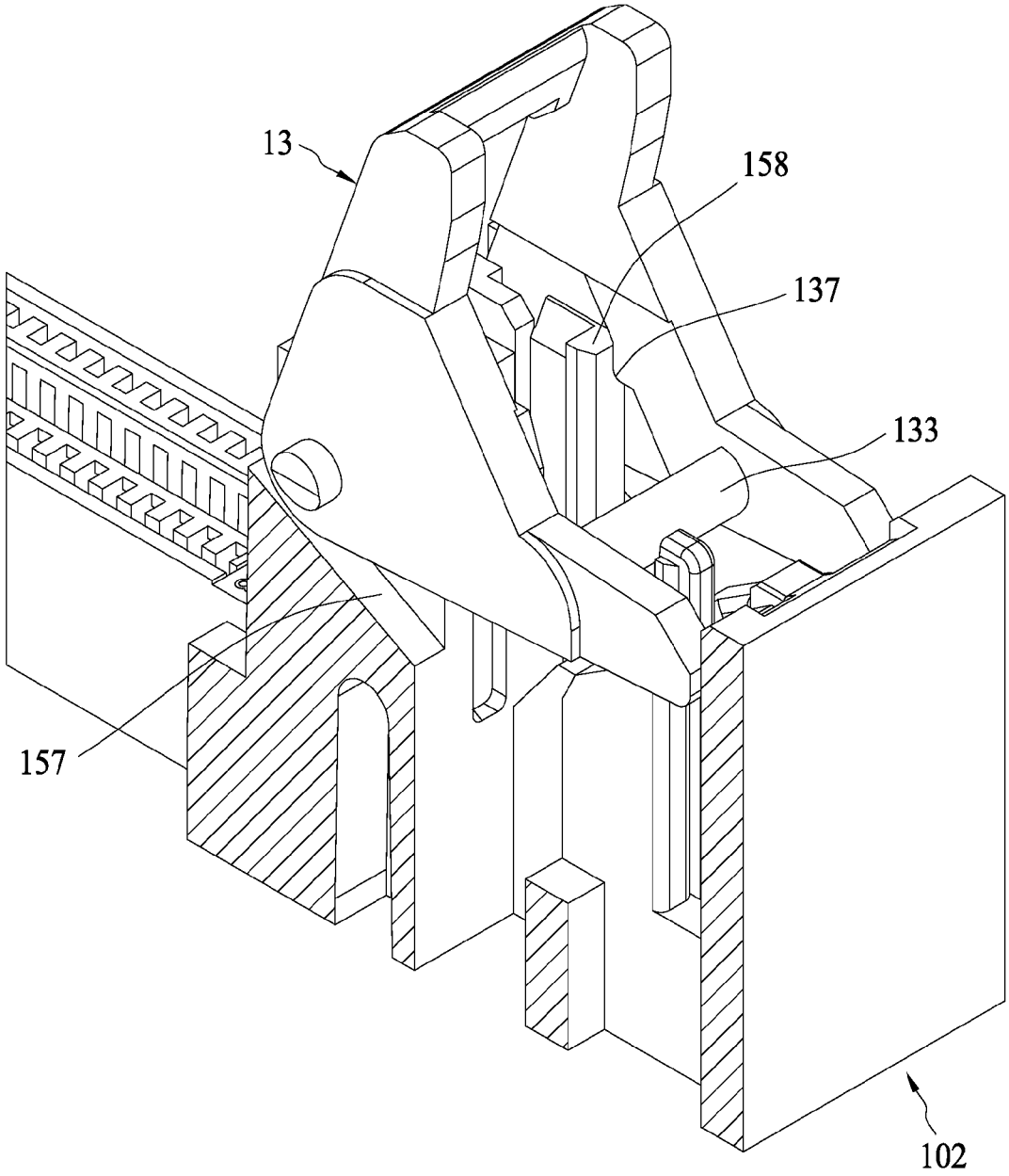
FIG. 9B is perspective cross-sectional view of the force transmitter depicted in FIG. 9A in a second position.

Referring primarily to FIG. 6, but also to FIG. 5 and FIG. 9B, the force transmitter 13, configured to transmit a force and to adjust the force according to the response of the force acceptor, has two substantially identical parallel twin force transmitter members 131, which are separated from each other and connected by spacer bars 132 and 133 (as shown in FIG. 9B). Each force transmitter member 131 comprises a lower arm 134, a pair of force transmitter pivots 135 disposed on opposite side surfaces of the force transmitter member 131, an upper arm 136 and a stopper 137. The upper arm 136 and the lower arm 134 can be substantially identical in length and an acute angle can be defined therebetween.

Figure 7A:
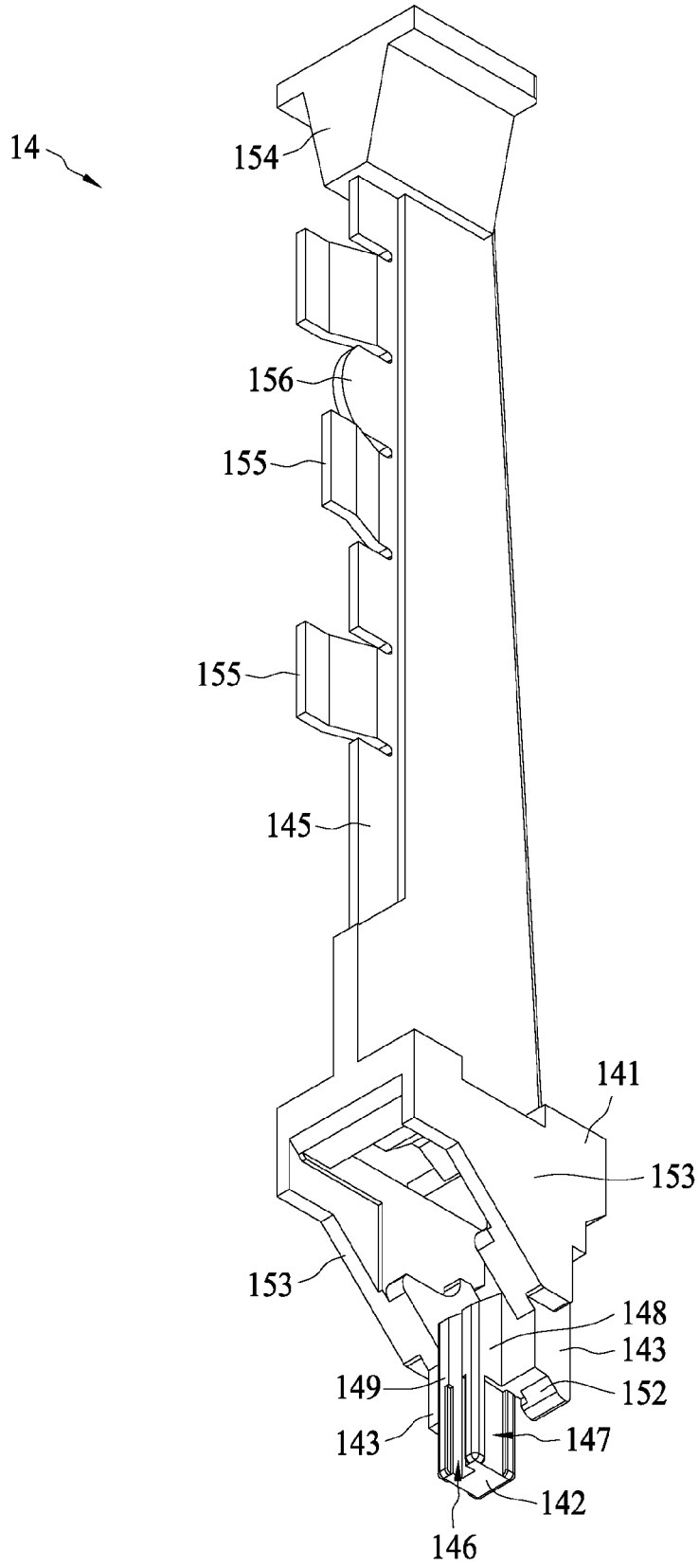
FIG. 7A shows an embodiment of an actuator.
Figure 7B:
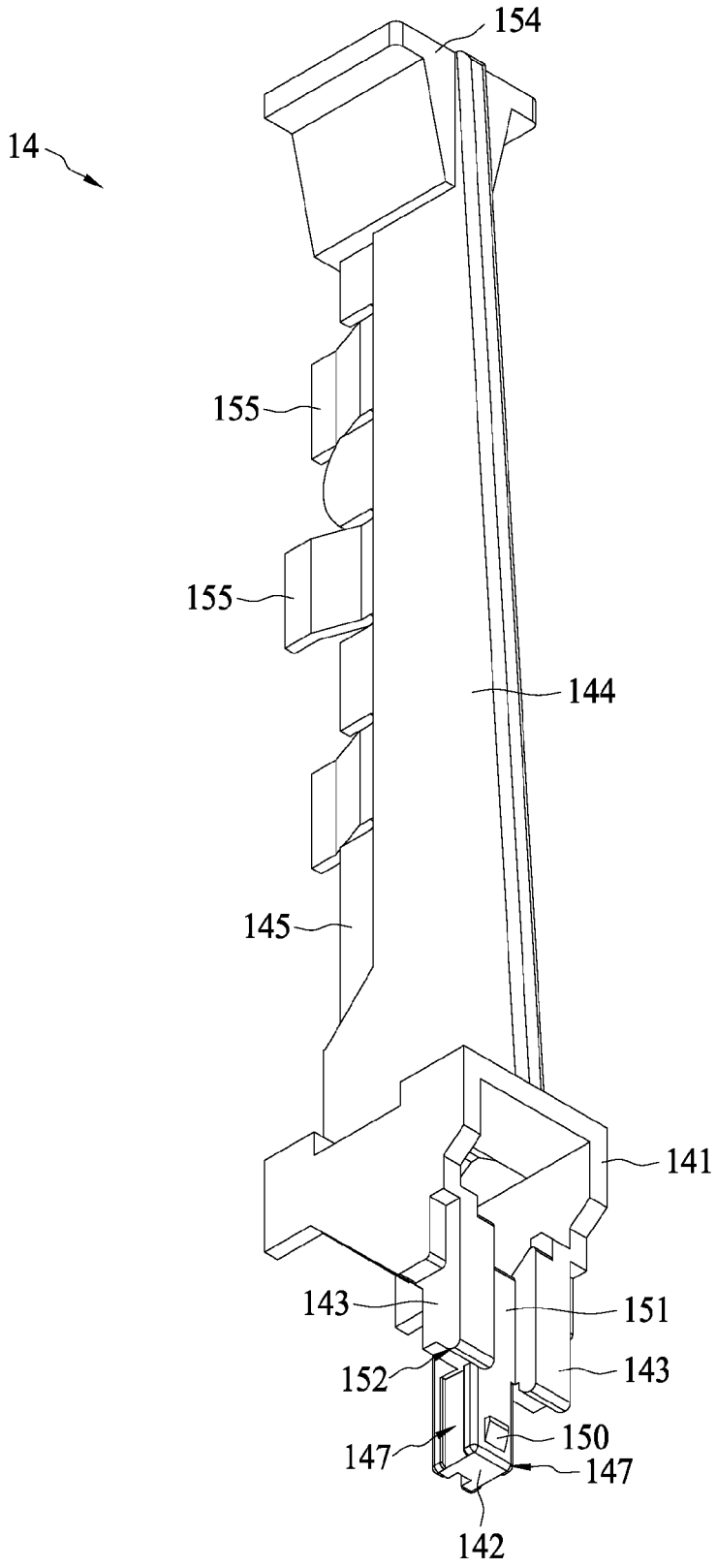
FIG. 7B shows an embodiment of an actuator.

Referring primarily to FIG. 7A and FIG. 7B, but also to FIG. 1 and FIG. 6, each actuator 14 comprises a base portion 141, a locating shaft 142 extending downward from the base portion 141, a pair of push arms 143 that extend downward from the base portion 141 and are disposed respective to the lower arms 134 of the force transmitter 13, an arm member 144 extending upward from the base portion 141 and a slide member 145 disposed at a side edge of the arm member 144. The locating shaft 142 guides the movement of the actuator 14 and comprises grooves 146, 147 on side surfaces 148 and a front surface 149 facing inward (toward the receptacle 101). A bump 150 is disposed on the back surface 151 (as shown in FIG. 7B) and is configured to prevent the actuator 14 from departing from the corresponding end tower 102. The push arms 143 are respectively disposed on either side of the locating shaft 142. Each push arm is supported by a respective sidewall 153 and has a concave surface 152 facing inward. The base portion 141 has an upside down U-shaped configuration with openings facing inward and outward respectively. The arm member 144 is formed in a plate-like shape for better airflow so as to achieve better heat dissipation of the card 3. A pushing member 154, configured for finger pushing, is disposed at the distal end thereof The arm member 144 can be made of plastic.

The slide member 145 is disposed at the arm member's side edge facing inward. The slide member 145 comprises a plurality of guide fins 155 arranged in a staggered pattern along the slide member 145 so as to prevent the actuator 14 from swinging when a force is applied on the pushing member 154. A stopper 156 with a round tip is disposed among the guide fins 155. The stopper 156 is able to engage the side edge 34 of the card 3 so as to prevent the actuator 14 from being pushed toward the card 3. The slide member 145 can be made of metallic materials.

Figure 8:
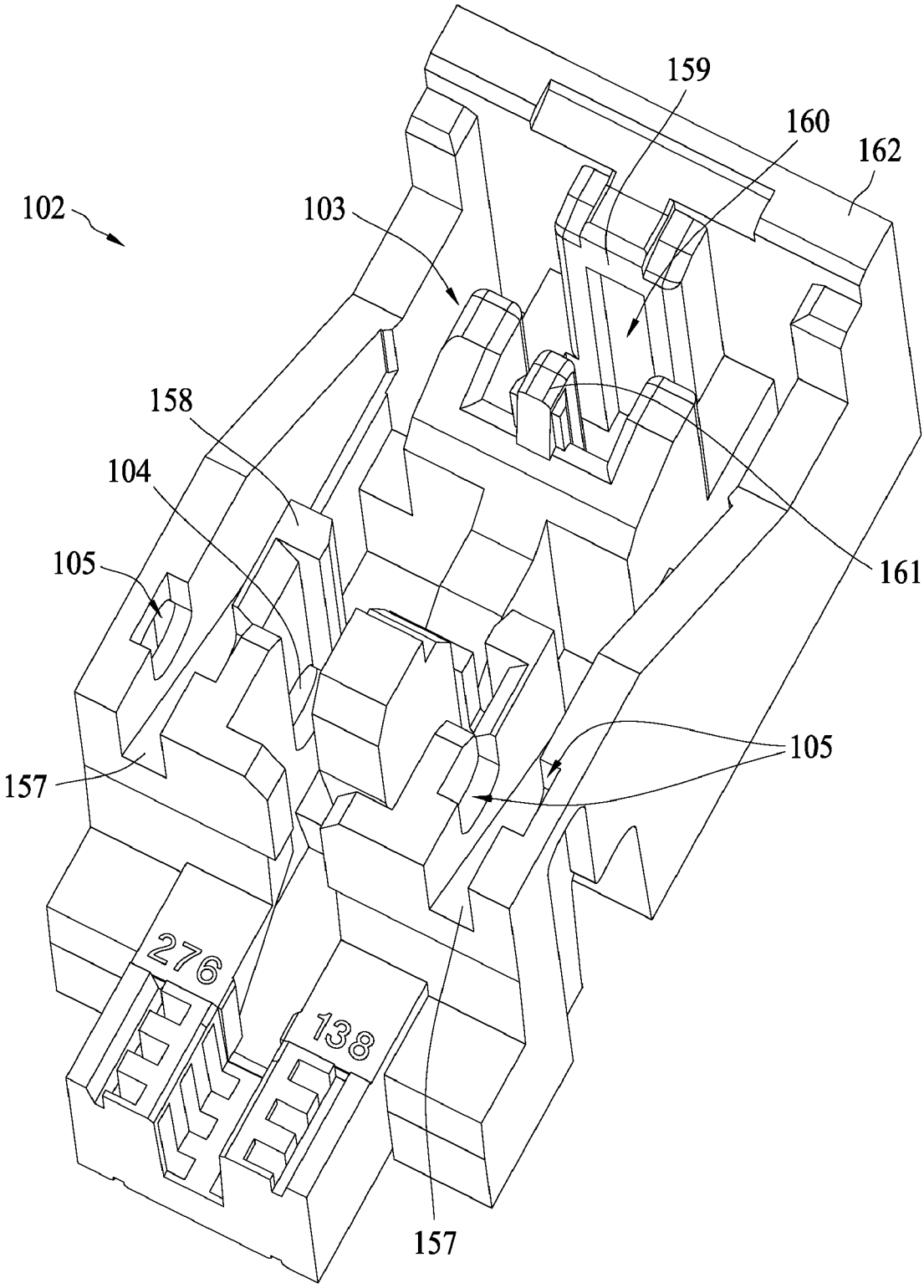
FIG. 8 is a perspective topside view showing an embodiment of an end tower.

Referring primarily to FIG. 8, but also to FIG. 1, FIG. 5, FIG. 6, FIG. 7A and FIG. 7B, each end tower 102 comprises a guide member 103, a pair of member pivot holes 104, a plurality of force transmitter pivot holes 105 and a plurality of cavities for receiving and allowing the respective engaging member 12 and the respective force transmitter 13 to move within the end tower 102 without interference. The member pivot holes 104 and the force transmitter pivot holes 105 are configured to receive the member pivots 122 of the engaging member 12 and the force transmitter pivots 135 of the force transmitter 13 respectively. Referring to FIGS. 9A and 9B, the rotation of the force transmitter 13 on the force transmitter pivots 135 is limited. When the force transmitter 13 is in the open position (i.e., with no card 3 inserted in the receptacle 101) as shown in FIG. 9A, the force transmitter 13 rests on slanted surfaces 157. In addition, when the force transmitter 13 is moved to the lock position as shown in FIG. 9B, the stoppers 137 of the force transmitter 13 engage the respective protruding blocks 158 and the force transmitter 13 is stopped from rotating further.

Referring primarily to FIG. 8, but also to FIG. 7A and FIG. 7B, the locating shaft 142 of each actuator 14 moves within the respective guide member 103 during card insertion and ejection operations. An inner wall 159 of the guide members 103 is provided with a groove 160 for the bump 150 of the actuator 14 so as to confine the movement of the actuator 14. A guide block 161 is provided respective to the groove 146 on the locating shaft 142 of the actuator 14 in the interior of each guide member 103. With the provision of the guide block 161, the actuator 14 can move more reliably.

Figure 10B:
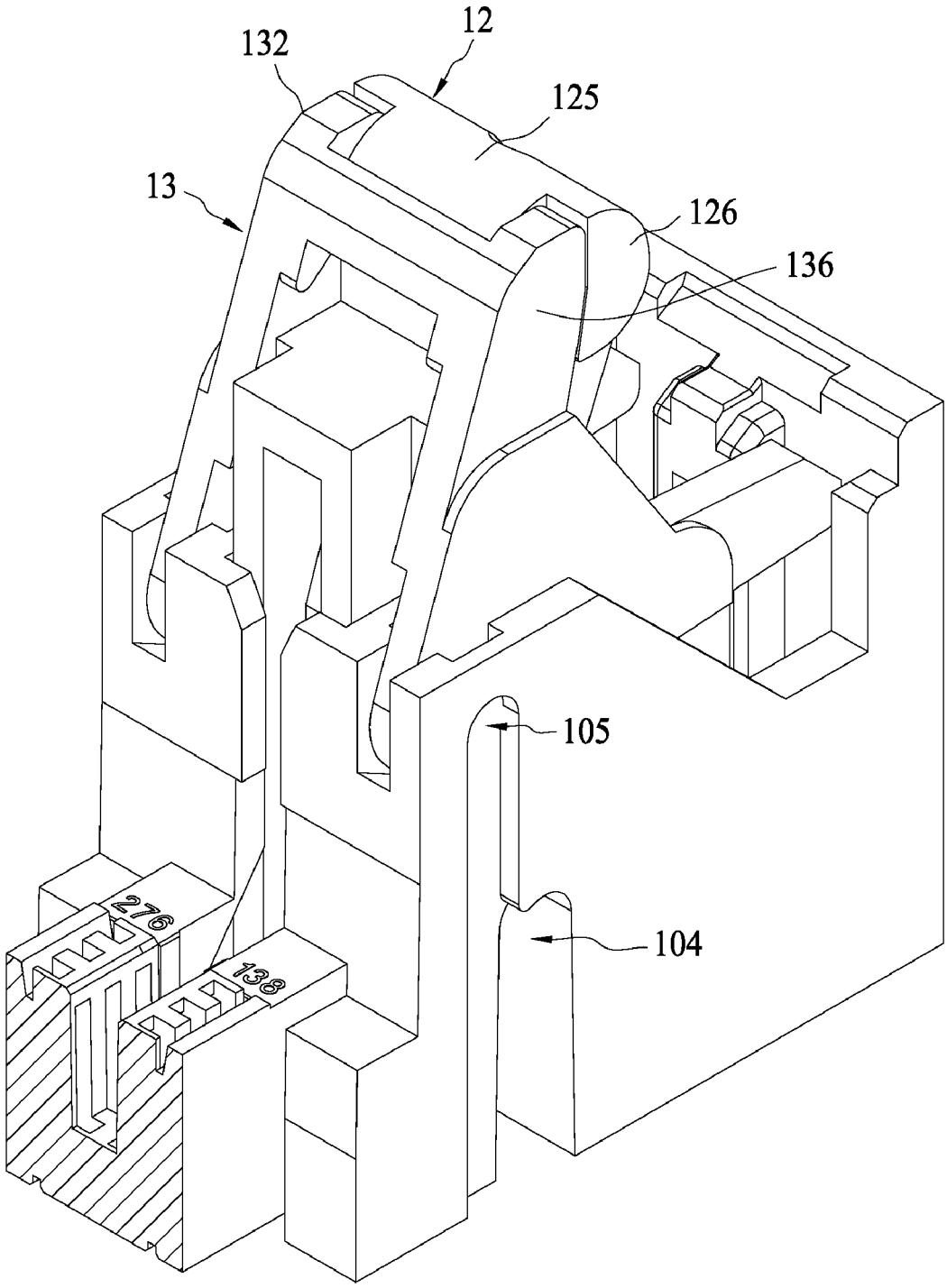
FIG. 10B is a perspective view showing an embodiment of engaging member and a force transmitter installed in an end tower.
Figure 10C:
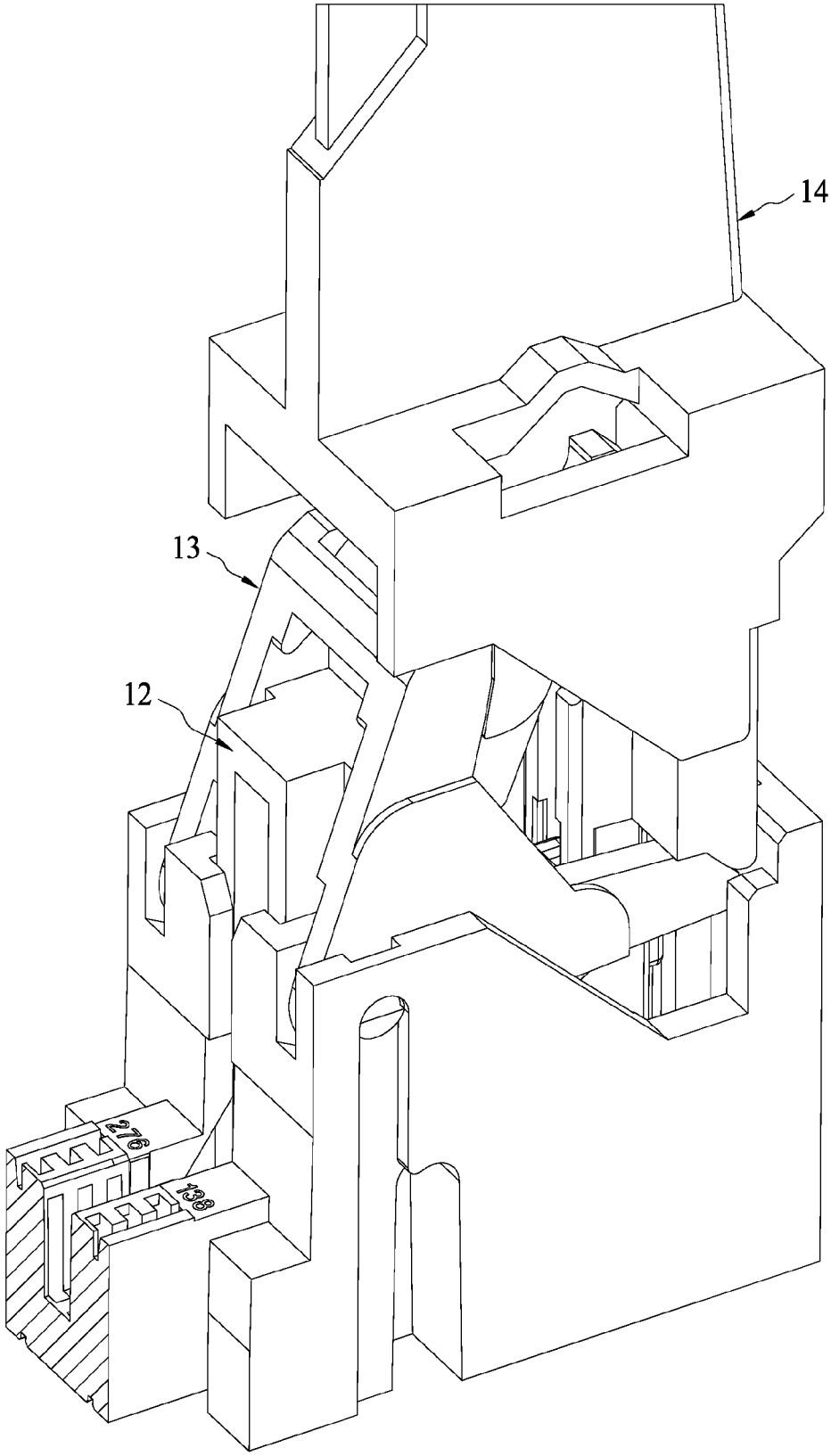
FIG. 10C is a perspective view of an embodiment of an ejection mechanism.

FIG. 10A through FIG. 10C illustrate a process for assembling an ejection mechanism. Referring primarily to FIGS. 10A to 10C, but also to FIGS. 5 to 8, each engaging member 12 is initially inserted into the respective end tower 102 and the member pivots 122 thereof are snapped into the respective member pivot holes 104. Next, the force transmitter 13 is inserted and the force transmitter pivots 135 thereof are snapped into the respective force transmitter pivots 105. The head portion 125 of the engaging member 12 is placed between the upper arms 136 and the shoulders 126 of the engaging member 12 are able to engage with the upper arms 136. Finally, the locating shaft 142 of the actuator 14 is inserted into the respective guide member 103 until the bump 150 on the locating shaft 142 is snapped into the groove 160.

Figure 11A:
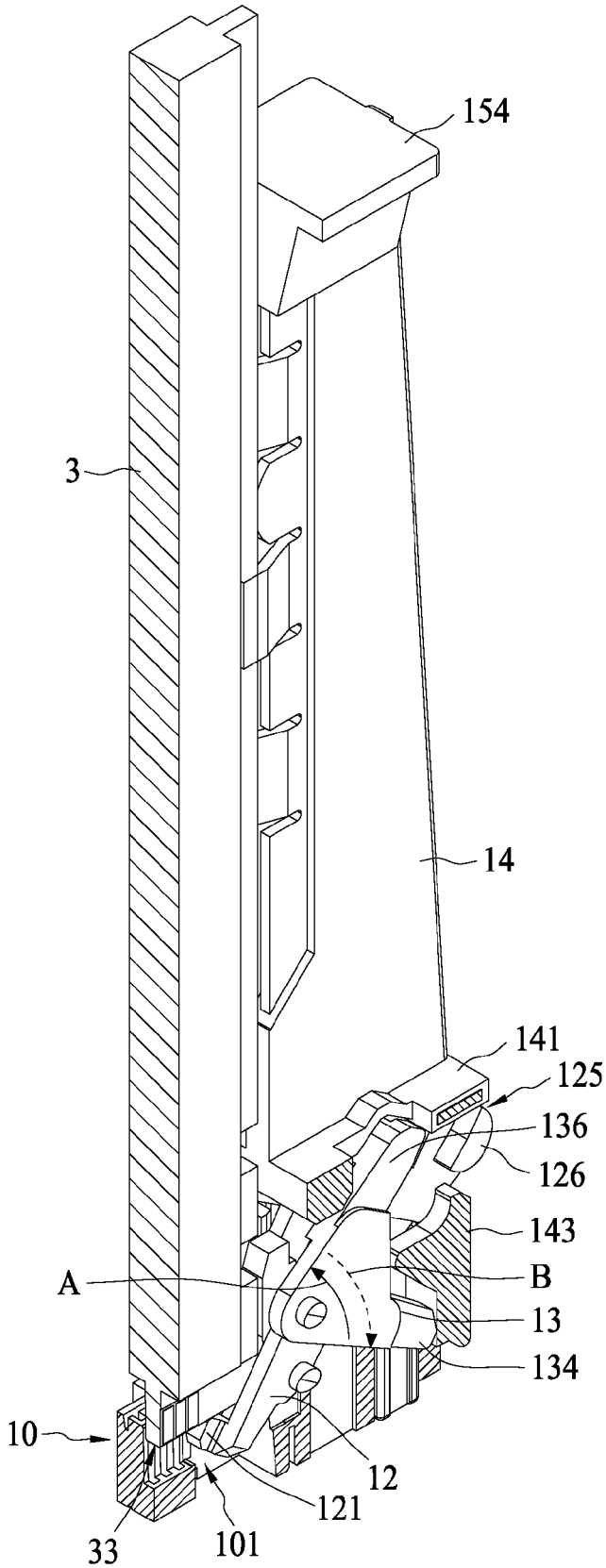
FIG. 11A shows an embodiment of an ejection mechanism with a partial card in a first position.
Figure 11B:
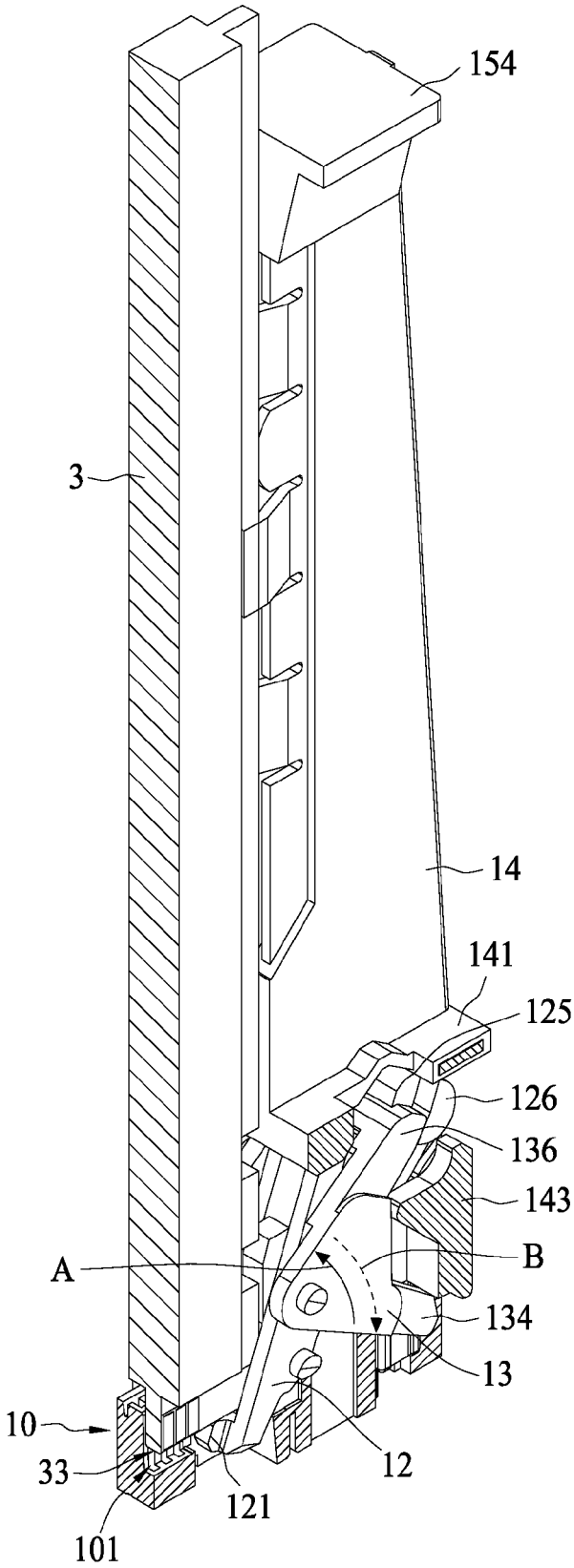
FIG. 11B shows the ejection mechanism of FIG. 11A with the partial card in a second position.
Figure 11C:
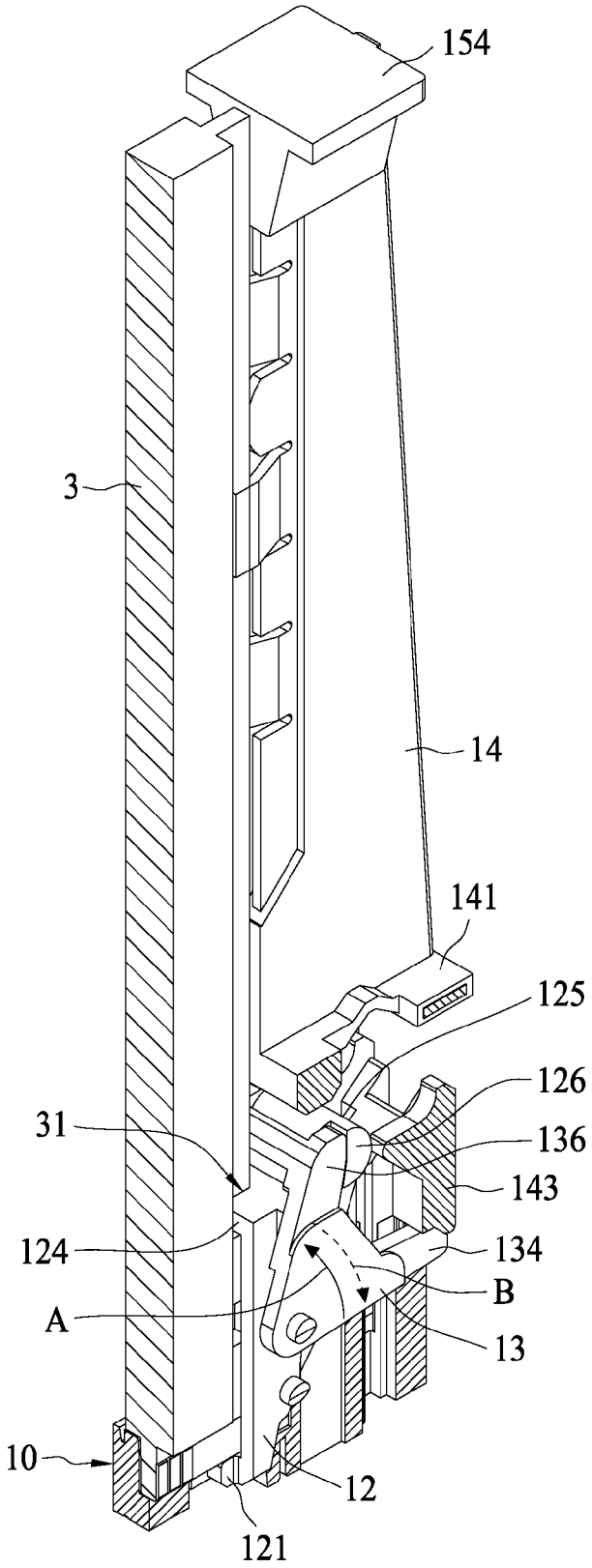
FIG. 11C shows the ejection mechanism of FIG. 11A with the partial card in a third position.

FIG. 11A through FIG. 11C illustrate procedures for inserting a card 3 into an embodiment of a card edge connector 1 and ejecting a card 3 from a card edge connector 1. The insertion and ejection procedures are demonstrated by one set of the ejection mechanism of the present embodiment. The other set works in a similar way. As illustrated in FIG. 11A, before the card 3 is inserted, the engaging member 12, the force transmitter 13 and the actuator 14 are all in an open position. Specifically, the force transmitter 13 rests on the slanted surfaces 157 (as shown in FIG. 9A); the actuator 14 is lowered to a lowest position; and the base portion 141 of the actuator 14 presses the head portion 125 of the engaging member 12 against the respective end wall 162 (shown in FIG. 8) so that the actuator 14 is held in the lowest position, and the engaging member 12 is tilted and the ejection portion 121 thereof reaches into the receptacle 101 ready for engaging with the elongated edge 33 of a card 3. As the card 3 starts to be inserted, the elongated edge 33 engages the ejection portion 121 of the engaging member 12 and pushes the engaging member 12 to rotate in the direction indicated by arrow A. The actuator 14 is lifted by the head portion 125 of the engaging member 12 due to the rotation (in the direction indicated by arrow A) of the engaging member 12.

As illustrated in FIG. 11B, the force transmitter 13 starts to rotate (in the direction indicated by arrow A) when the shoulders 126 of the engaging member 12 engage the upper arms 136 of the force transmitter 13. At this moment, the actuator 14 is still lifted by the head portion 125 of the engaging member 12. As the engaging member 12 continues to rotate the force transmitter 13 and lift the actuator 14, the lower arms 134 of the force transmitter 13 eventually engage the push arms 143 of the actuator 14, and after the engagement between the push arms 143 and the lower arms 134, the actuator 14 is lifted only by the lower arms 134.

As illustrated in FIG. 11C, after the card 3 is fully installed, the engaging member 12, the force transmitter 13 and the actuator 14 are all in a lock position. Specifically, the ejection portion 121 of the engaging member 12 is at the lowest position thereof; the latch portion 124 engages the respective notch 31; the actuator 14 is lifted to the highest position and supported by the lower arms 134 of the force transmitter 13.

The card ejection procedures are carried out in reverse order compared to the steps described above. As illustrated in FIG. 11C, when a force is applied on the pushing member 154, the force transmitter 13 transmits the force to rotate the engaging member 12 to initiate the card ejection process. More specifically, the force drives the push arms 143 to push the lower arms 134 of the force transmitter 13, causing the force transmitter 13 to rotate (in the direction indicated by arrow B), and cause the upper arms 136 to drag the shoulders 126 so that the force is transmitted to the ejection portion 121 of the engaging member 12. Once the engaging member 12 is driven, the engaging member 12 rotates in the direction indicated by arrow B. The latch portion 124 starts to disengage and the ejection portion 121 pushes the card 3 upward simultaneously.

The push arms 143 are not involved in the ejection process until the engaging member 12 is enabled to directly transmit the force to the ejection portion 121 as shown in FIG. 11B. After the push arms 143 disengage the lower arms 134 of the force transmitter 13, the head portion 125 of the engaging member 12 engages the base portion 141 of the actuators and the card 3 is moved under the influence of leverage provided by the engaging member 12 rotated in the direction indicated by arrow B.

As illustrated in FIG. 11C, the head portion 125 is disposed at one end of the engaging member 12, and the ejection portion 121 is disposed at another end of the engaging member 12. The member pivots 122 are closer to the ejection portion 121 than the head portion 125. The upper arm 136 engages the respective engaging surface 130 so that the direction of a force applied by the upper arm 136 is substantially tangent to movement of the head portion 125. Such arrangement achieves approximately the largest possible leverage moment. Moreover, the force transmitter 13 can change the direction of the force applied therefrom in response to the rotation of the engaging member 12. Specifically, due to the arrangement of both the engaging member 12 and the force transmitter 13, the force direction changes due to the rotation of the force transmitter 13 and can remain substantially tangent to the movement of the head portion 125 so that the effective lever arm length of the engaging member 12 is not changed too much and the leverage moment is not decreased significantly. Due to the nearly maximum leverage moment, an inserted card can be easily ejected. Furthermore, during the card insertion or ejection operation, the actuator 14 always moves linearly. There is no lateral interference caused by the actuator 14.

Figure 12:
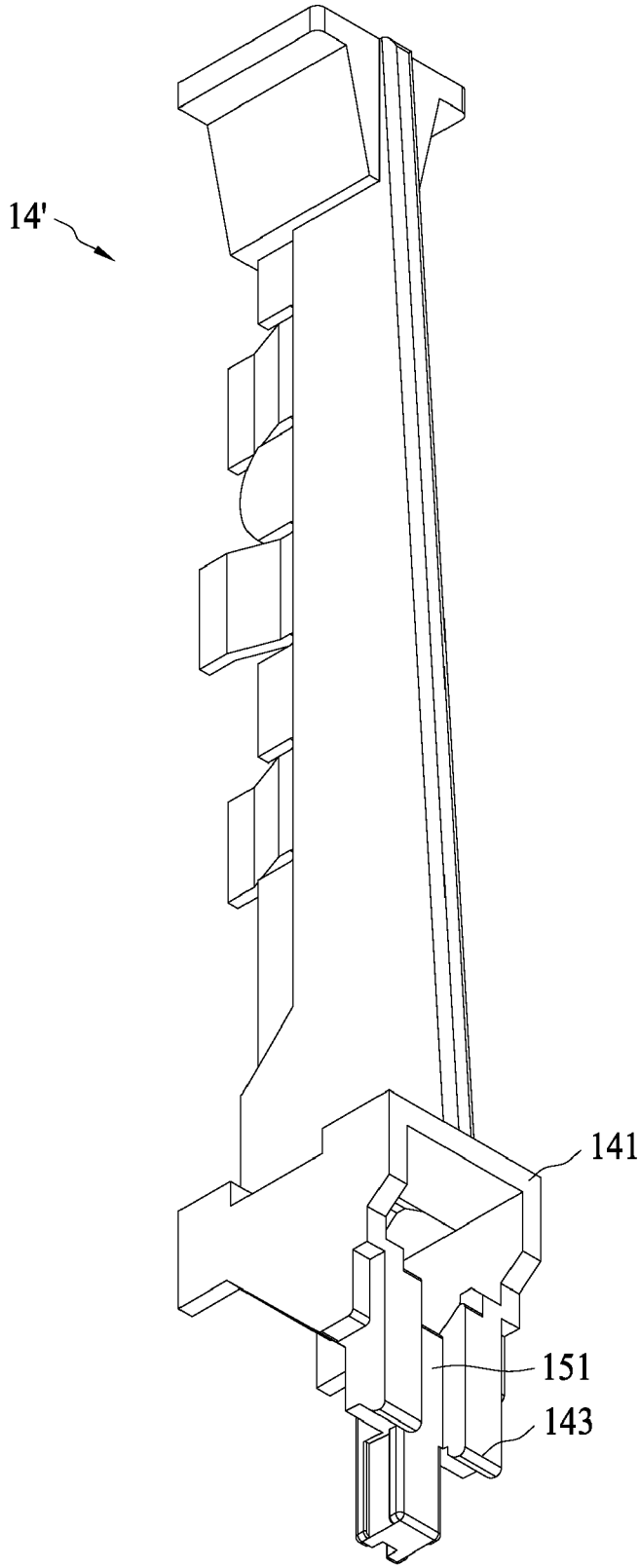
FIG. 12 shows an embodiment of actuator.
Figure 13:
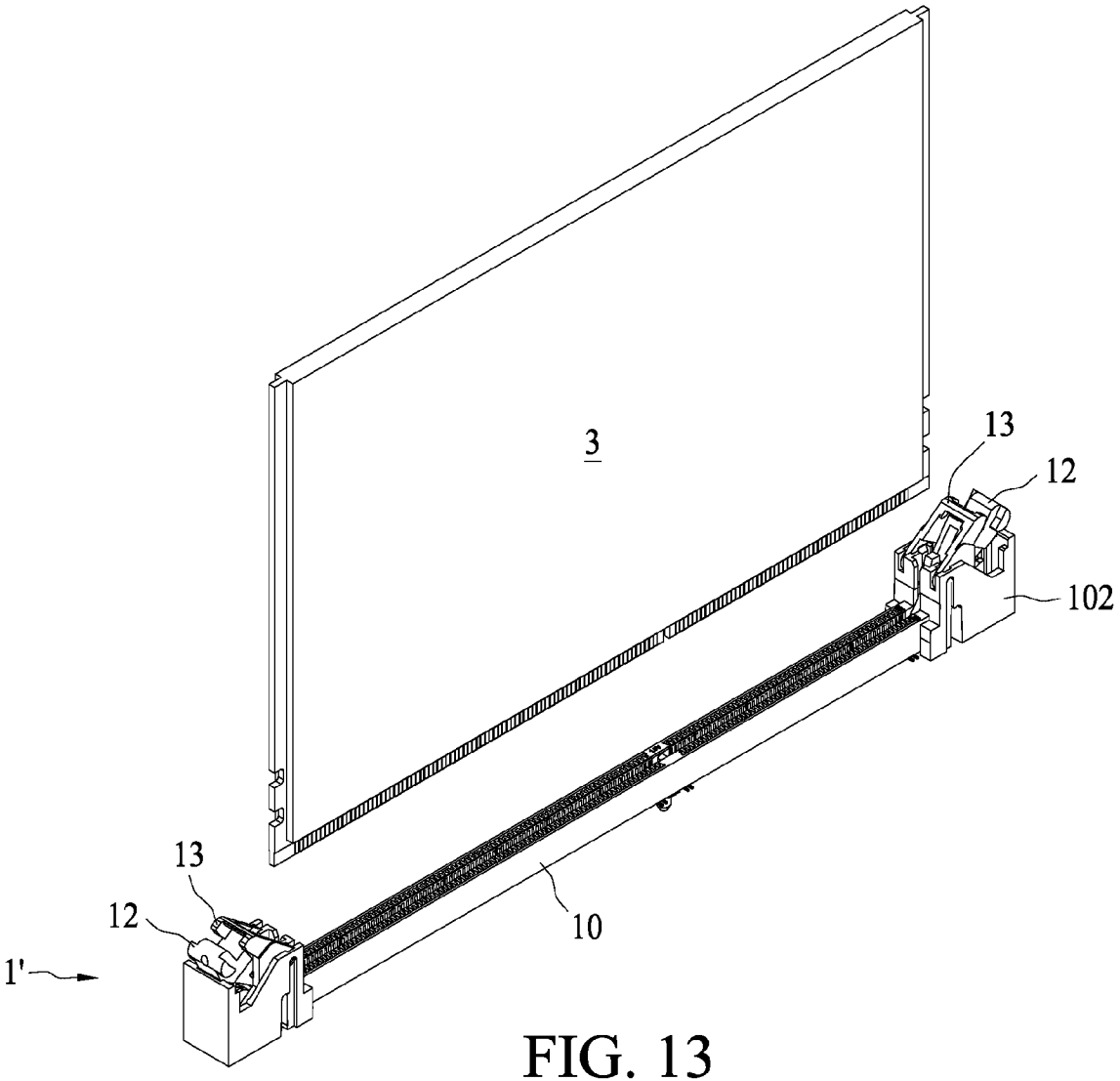
FIG. 13 illustrates an embodiment of a card edge connector adopting the actuator shown in FIG. 12.
Figure 14:
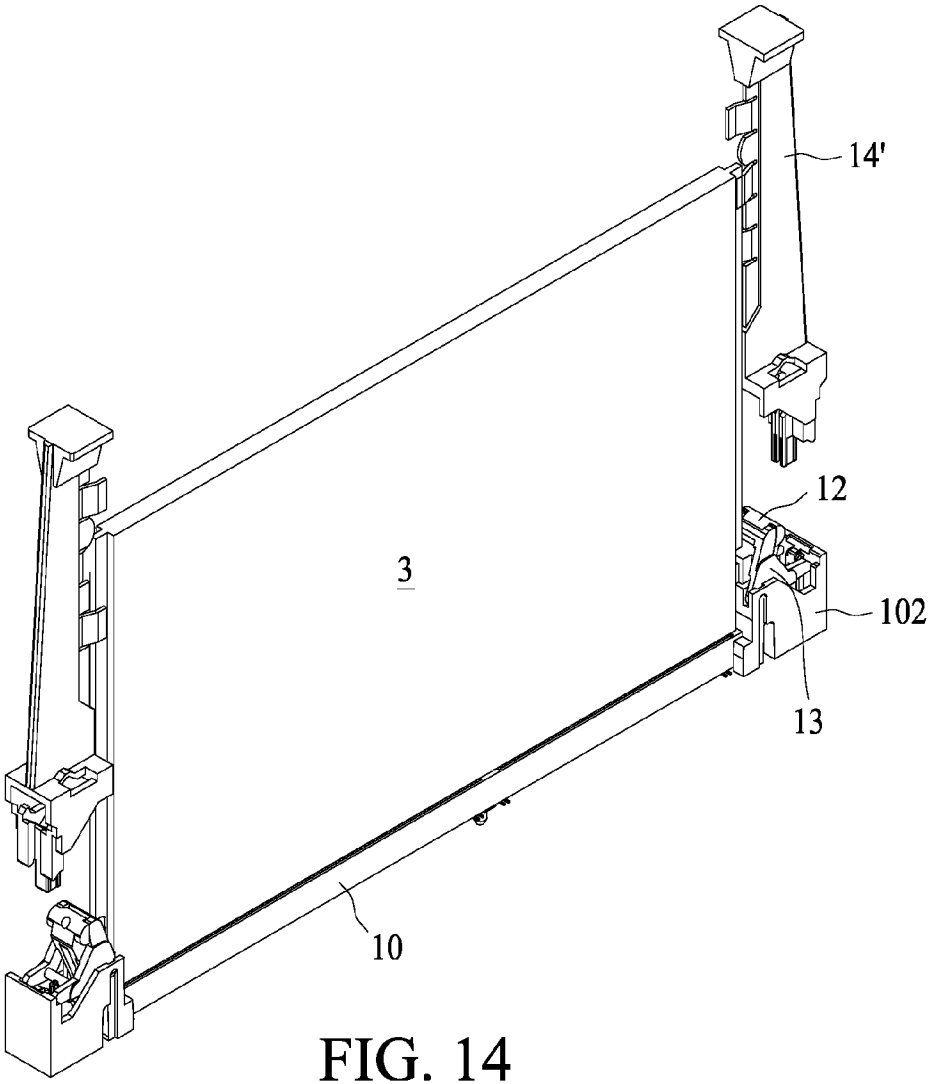
FIG. 14 illustrates an embodiment of a card edge connector adopting the actuator shown in FIG. 12.

Referring primarily to FIGS. 12-14, but also to FIG. 1 and FIG. 7B, the above-described bump 150 (as shown in FIG. 7B) is configured to prevent the actuator 14 from departing from the corresponding end tower 102. A detachable actuator 14' can also be provided, without the above described bump 150. The actuators 14' without the bump 150 don't have to be installed into the end towers 102 all the time. The card 3 can be directly inserted into the card edge connector 1' (as shown in FIG. 13). The engaging members 12 and the force transmitters 13 rotate to the lock position after the card 3 is inserted (as shown in FIG. 14). If the card 3 is ready to be ejected, the actuators 14' are then inserted into the end towers 102, and thereafter, a force applied thereon. The force transmitters 13 transmit the force from the actuators 14' and rotate the engaging members 12 to push the card 3. After the card 3 is ejected, the actuators 14' can be removed from the end towers 102, and the card edge connector 1' is ready for next card insertion.

Figure 15:
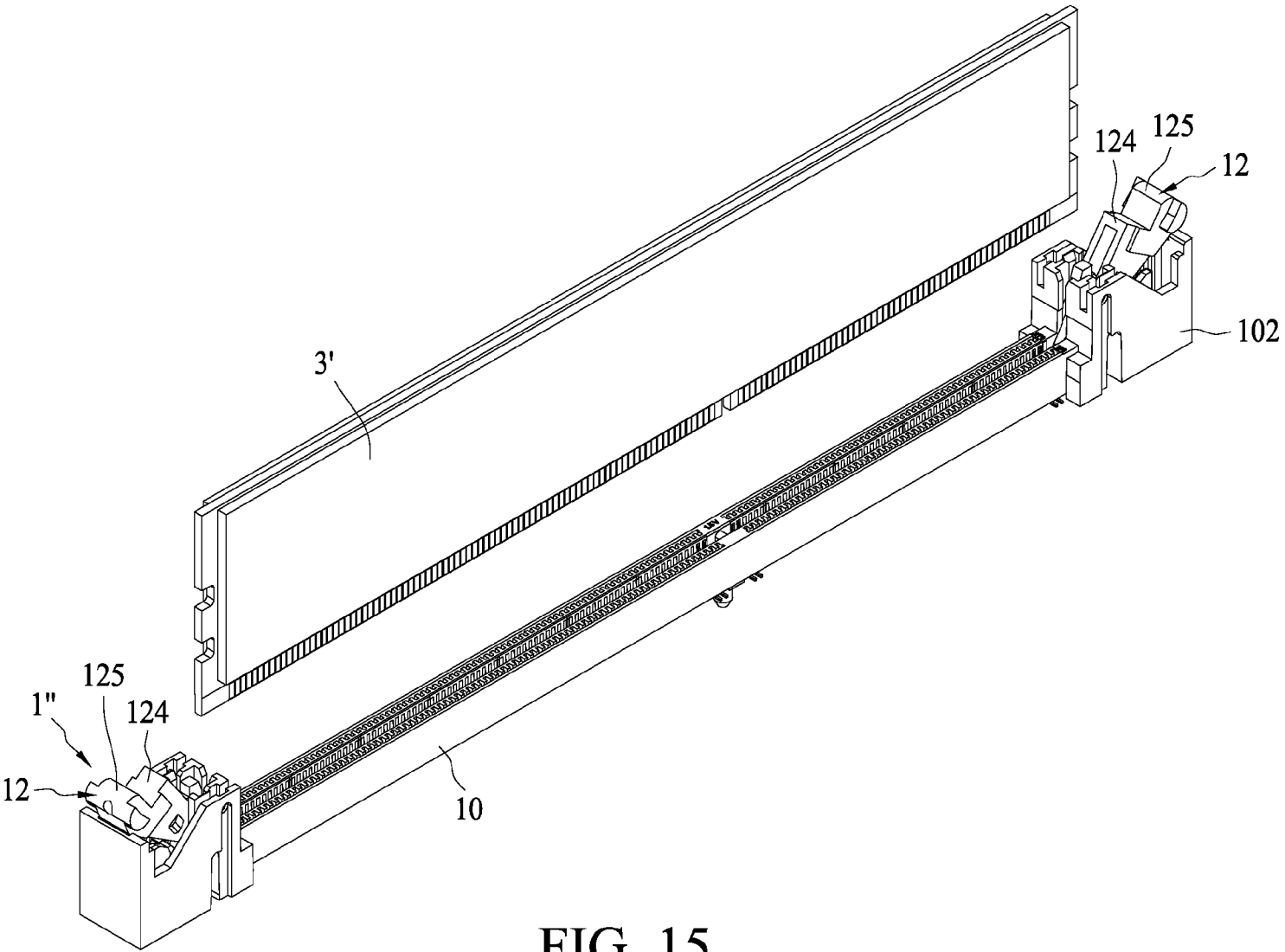
FIG. 15 illustrates an embodiment of card edge connector that is receiving a card.

Referring primarily to FIG. 15, but also to FIG. 1 and FIG. 13, one advantage of the depicted card edge connector 1 is that the card edge connector 1 is designed to receive cards of different heights. In addition, the design of the card edge connector 1 does not need any modification or duplication for different sizes of cards. As illustrated in FIG. 1, the card edge connector 1 can receive a tall card 3 and can easily be manipulated to eject the card 3. When a card edge connector 1", as shown in FIG. 15, is designated to receive a standard-size card 3', the actuators 14 are not required to be used to eject the card 3' because the card 3' does not obstruct access to ejection mechanisms. Under such application, the card edge connector 1 used for the tall card 3 as shown in FIG. 1 can still be used, but the actuators 14 and the force transmitters 13 need not be installed within the end towers 102. The card 3' is latched by the latch portion 124 of the engaging members 12 when the card 3' is inserted, and the card 3' can be ejected by applying a force on the head portions 125 of the engaging members 12.

In summary, the depicted card edge connector can include an actuator having a height tall enough to allow a user to easily eject a tall card without access problems. The actuator can be a detachable actuator so that the card edge connector is more convenient for use with cards of any size. Because the force transmitter is actuated by the actuator to apply a force to rotate the engaging member and changes a direction of the force in response to rotation of the engaging member, and the direction of the force is substantially tangent to movement of the head portion of the engaging member, the engaging member can gain a maximum leverage moment and maintain substantially the maximum leverage moment efficiency during card ejection. Consequently, the card edge connector can easily and safely eject an inserted card.

The above-described embodiments are intended to be illustrative only. Numerous alternative embodiments may be devised by persons skilled in the art without departing from the scope of the following claims.

What is claimed is:

1. A card edge connector comprising:

an insulating housing comprising at least one end tower, each end tower disposed at an end of the insulating housing;

a plurality of terminals provided within the insulating housing, wherein the insulating housing is configured to receive an elongated edge of a mating card with a plurality of contact pads and the terminals are configured to electrically and mechanically engage the contact pads;

an actuator having a push arm that is substantially linearly movable within the end tower;

an engaging member pivoted to rotate within the end tower, and configured to rotate in one direction to secure the card and to rotate in another direction to eject the card; and a force transmitter pivoted to rotate within the end tower, and engageable with the push arm of the actuator and the engaging member, wherein the force transmitter is actuated by the actuator to apply a force to rotate the engaging member and changes a direction of the force in response to rotation of the engaging member.

2. The card edge connector of claim 1, wherein the actuator further comprises a base portion, and the engaging member comprises:

a latch portion engageable with one of the notches for securing the card;

an ejection portion disposed at one end of the engaging member, the ejection portion being engageable with the elongated edge of the card for applying an ejection force on the elongated edge; and a head portion disposed at another end of the engaging member, the head portion being engageable with the base portion;

wherein the push arm extends downward from the base portion, and the base portion of the actuator engages the head portion when the engaging member disengages the force transmitter.

3. The card edge connector of claim 2, wherein the head portion of the engaging member comprises a shoulder, and the force transmitter comprises an upper arm engageable with the shoulder and a lower arm engageable with the push arm of the actuator.

4. The card edge connector of claim 2, wherein the force transmitter comprises an upper arm engageable with the head portion of the engaging member and a lower arm engageable with the push arm of the actuator, wherein the actuator engages the head portion when the push arm disengages the lower arm of the force transmitter.

5. The card edge connector of claim 2, wherein the head portion of the engaging member comprises a shoulder, and the force transmitter comprises an upper arm engageable with the shoulder and a lower arm engageable with the push arm of the actuator, wherein the actuator engages the head portion when the push arm disengages the lower arm of the force transmitter.

6. The card edge connector of claim 5 wherein the upper arm and the lower arm are substantially identical in length and an acute angle is defined therebetween.

7. The card edge connector of claim 5 wherein the actuator further comprises a locating shaft extending downward from the base portion, and the end tower comprises a guide member, wherein the locating shaft moves substantially linearly within the guide member.

8. The card edge connector of claim 7, wherein the actuator further comprises a bump provided on the locating shaft and the guide member further comprises a groove disposed respective to the bump, wherein the bump is received within the groove when the locating shaft is inserted into the guide member, and movement of the actuator is confined by a combination of the bump and the groove.

9. The card edge connector of claim 7, wherein the actuator further comprises an arm member extending upward from the base portion and a pushing member disposed at a distal end of the arm member.

10. The card edge connector of claim 9, wherein the actuator further comprises a slide member that is disposed at the arm member's side edge facing inward, wherein the slide member comprises a plurality of guide fins that are in a staggered pattern along the slide member and a stopper that is disposed among the guide fins.

* * * * *